United States Patent [19]

Forster

[11] 4,097,188

[45] Jun. 27, 1978

[54] NOZZLE INSERT FOR A TURBINE

[76] Inventor: Terence Owen Forster, 14 Stamford Rd., Exton, Oakham, Leics., England

[21] Appl. No.: 786,968

[22] Filed: Apr. 13, 1977

[30] Foreign Application Priority Data

Apr. 15, 1976 United Kingdom ..... 15458/76

[51] Int. Cl.[2] ..... F01D 9/02

[52] U.S. Cl. ..... 415/202; 415/217

[58] Field of Search ..... 415/202, 134, 217, 218

[56] References Cited

U.S. PATENT DOCUMENTS

| | | | |
|---|---|---|---|
| 973,472 | 10/1910 | Broadbent | 415/217 |
| 1,266,973 | 5/1918 | Metten | 415/217 |
| 1,352,276 | 9/1920 | Junggren | 415/217 |
| 1,553,083 | 9/1925 | Junggren | 415/202 |
| 2,196,045 | 4/1940 | Warren et al. | 415/217 |
| 2,196,062 | 4/1940 | Doran | 415/217 |
| 2,447,942 | 8/1948 | Imbert et al. | 415/217 |
| 2,780,436 | 2/1957 | Holzwarth | 415/202 |
| 3,038,699 | 6/1962 | Kaplan | 415/217 |
| 3,860,360 | 1/1975 | Yu | 415/211 |
| 4,025,229 | 5/1977 | Browning et al. | 415/217 |

FOREIGN PATENT DOCUMENTS

| | | | |
|---|---|---|---|
| 1,225,667 | 9/1966 | Germany | 415/217 |
| 178,004 | 6/1935 | Switzerland | 415/217 |
| 226,798 | 6/1925 | United Kingdom | 415/217 |
| 227,457 | 3/1925 | United Kingdom | 415/217 |
| 776,988 | 6/1957 | United Kingdom | 415/217 |

*Primary Examiner*—C. J. Husar

*Attorney, Agent, or Firm*—Spensley, Horn & Lubitz

[57] ABSTRACT

A nozzle insert for a turbine and a turbine embodying a plurality of such nozzles. The nozzles are removably mounted in the turbine to enable them to be readily replaced in the event of damage. Each nozzle has a working fluid passageway extending therethrough and forming a rectangular exit in a turbine blade-confronting surface. The passageway includes an arcuate or otherwise curved section adjacent an inlet of the passageway and a rectilinear section adjacent the exit of the passageway.

14 Claims, 15 Drawing Figures

NOZZLE INSERT FOR A TURBINE

Figure 1:
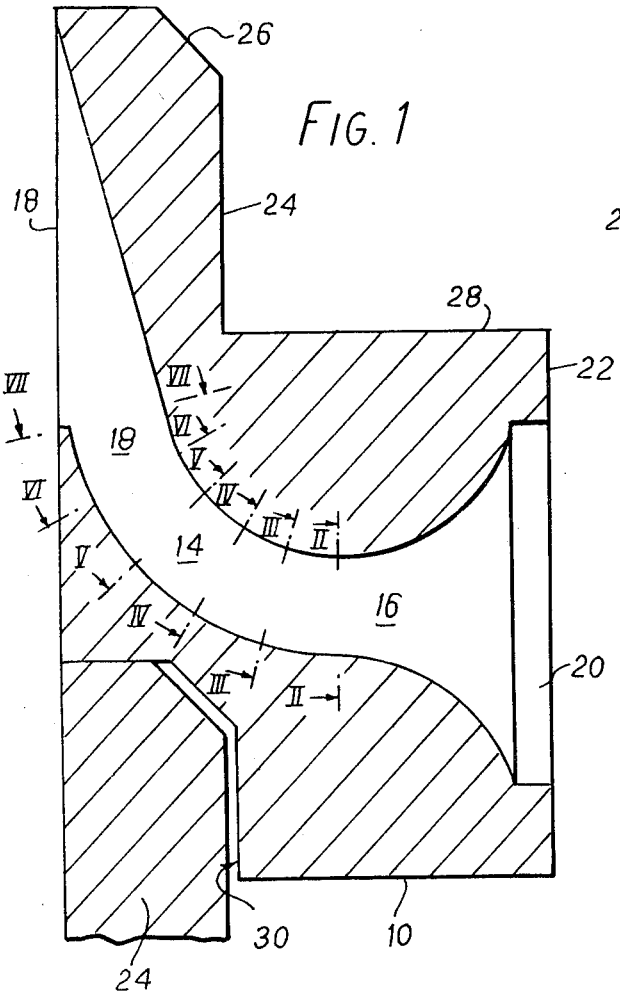

The present invention relates both to a nozzle insert for a turbine, such as a steam turbine, and to a turbine embodying such a nozzle insert.

In a steam turbine steam is expanded in a nozzle or nozzles from an initial steam pressure, thereby converting heat and pressure energy of the steam into kinetic energy flow. Some part of this kinetic energy is then absorbed by rotor blades attached to a rotor.

A typical turbine construction includes a rotor assembly having a plurality of equi-angularly spaced, curved rotor blades provided on the periphery thereof, the rotor being mounted in bearings within a casing. A plurality of steam nozzle inserts located adjacent the rotor blades each expand steam at the initial steam pressure to a second, lower pressure which is contained within the casing, and the resulting steam jets are directed on to the curved rotor blades to rotate the floor. After giving up some of its kinetic energy to the rotor blades, the steam leaves the turbine exhaust branch in known manner.

One known nozzle type has a fluid passageway of circular cross section to enable the nozzle to be produced cheaply by a simple drilling and reaming operation. One disadvantage with this type of nozzle however is that a long eliptically shaped passageway exit is produced which prevents close pitching of the passageways. A second disadvantage is that the circular cross-sectional shape of the jet of working fluid produced does not match the rectangular gap between adjacent rotor blades. A third disadvantage is that the direction which the passageway imparts to the jet of working fluid and also of the exit ellipses major axis controlling the direction of the working fluid jet cannot match exactly the curved path along which the rotating blades travel. Hence some of the kinetic energy of the working fluid is wasted.

Another known nozzle insert has a passageway exit of rectangular cross section and of similar dimensions as the gap between the turbine blades. The insert is formed in two parts forming the passageway therebetween. This type of insert requires high precision machining and assembly to prevent steam leakage problems between the componentp parts and a pressure vessel which receives them. In practice, it has been found necessary to weld the joint faces of the components to produce a steam-tight assembly but this obviates future nozzle removal and replacement.

Both of the above types of nozzle, once machined, are applicable to only one mode of rotation of the rotor blade and to only one mean diameter thereof.

In accordance with the present invention there is provided a nozzle insert for a turbine having a working fluid passageway extending therethrough and forming a rectangular exit in a turbine blade-confronting surface of the insert, said passageway having an arcuate section adjacent an inlet of the passageway and a rectilinear section adjacent the exit from the passageway, a centre line through the rectilinear section of the passageway making an acute angle with said turbine blade-confronting surface.

Also in accordance with the present invention there is provided a turbine comprising a casing within which a rotor carrying a plurality of angularly spaced rotor blades is rotatably received, means removably mounting a plurality of nozzle inserts in said casing each insert being arranged, in use, to direct working fluid at said rotor blades to thereby rotate said rotor, each insert having a working fluid passageway extending therethrough and forming a rectangular exit in a turbine blade-confronting surface of the insert, said passageway having an arcuate section adjacent an inlet of the passageway and a rectilinear section adjacent the exit from the passageway, a centre line through the rectilinear section of the passageway making an acute angle with said turbine blade-confronting surface.

Figure 8:
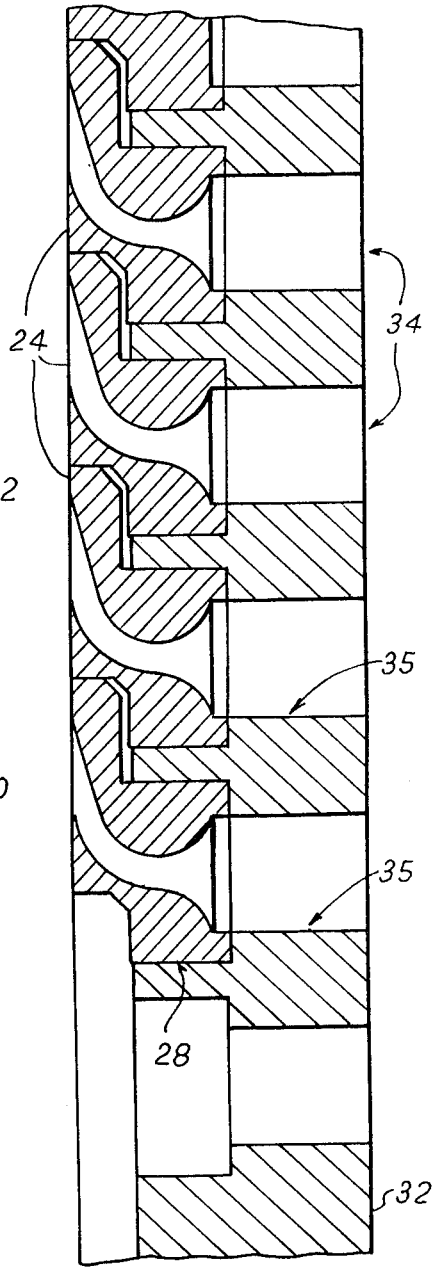
Figure 2:
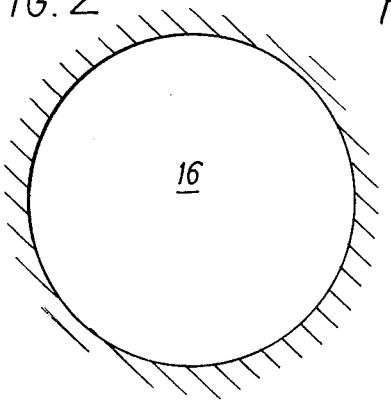
Figure 5:
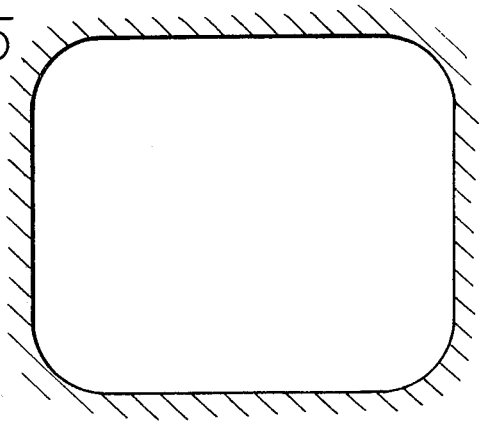
Figure 3:
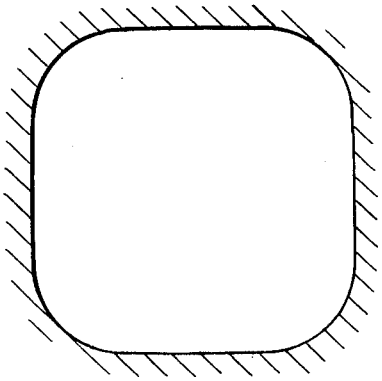
Figure 6:
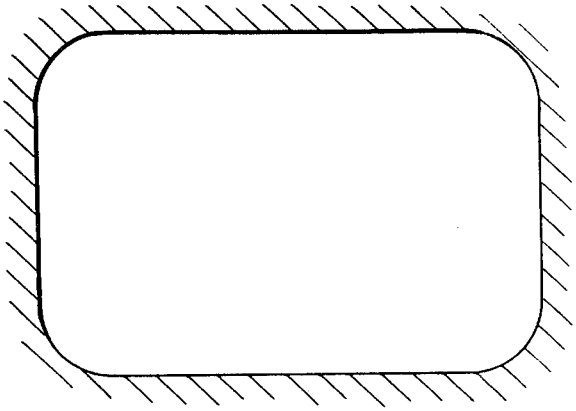
Figure 4:
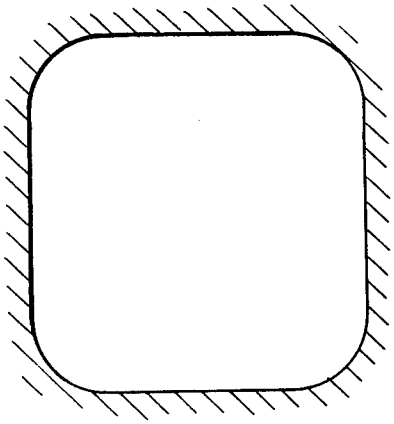
Figure 7:
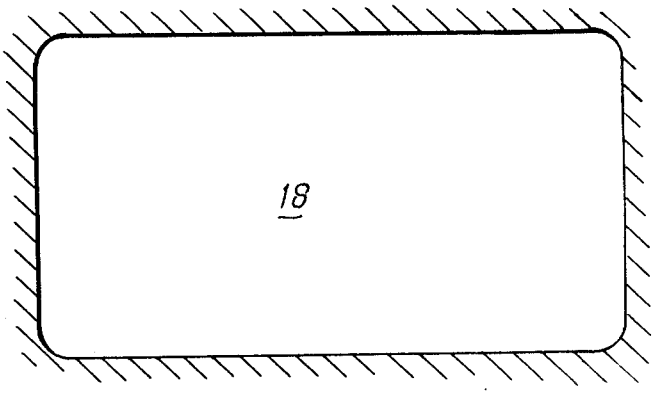
Figure 9:
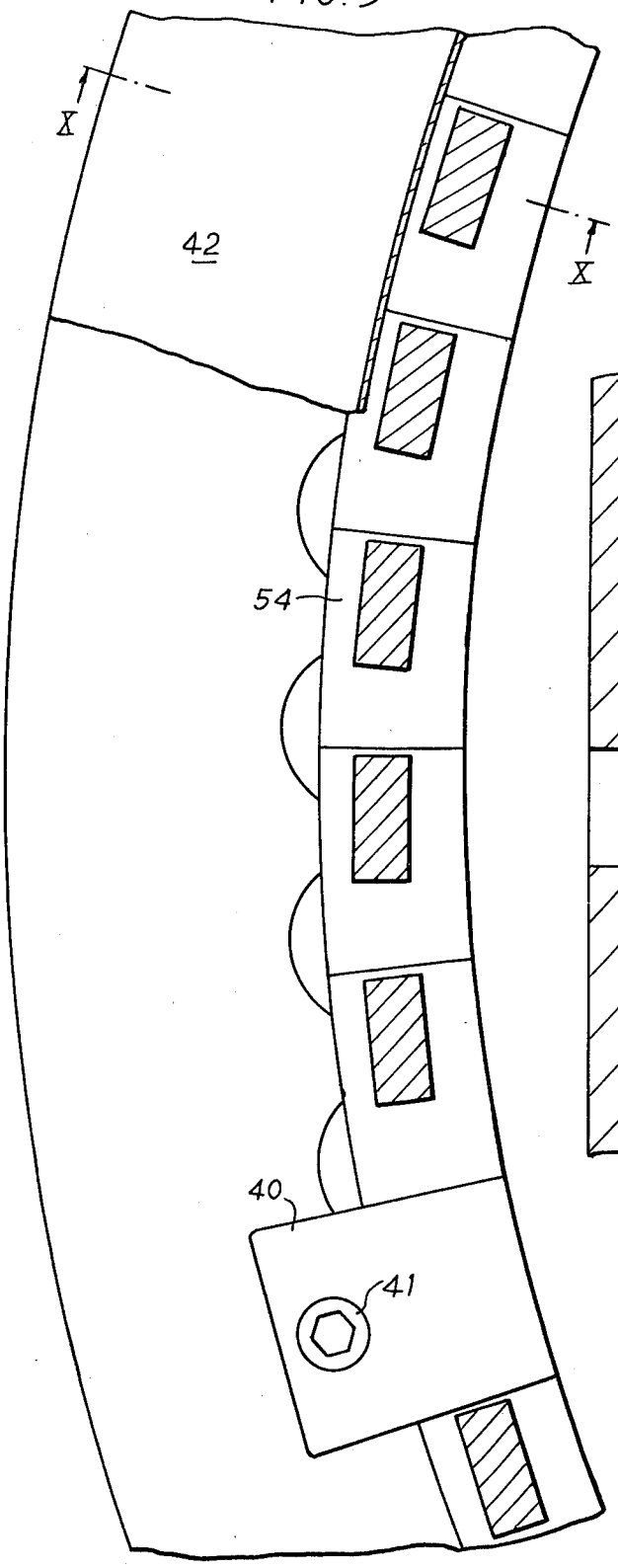
Figure 10:
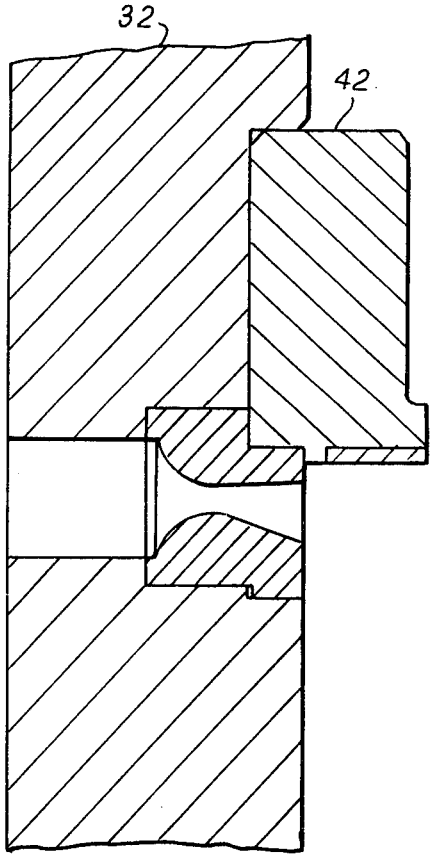
Figure 11:
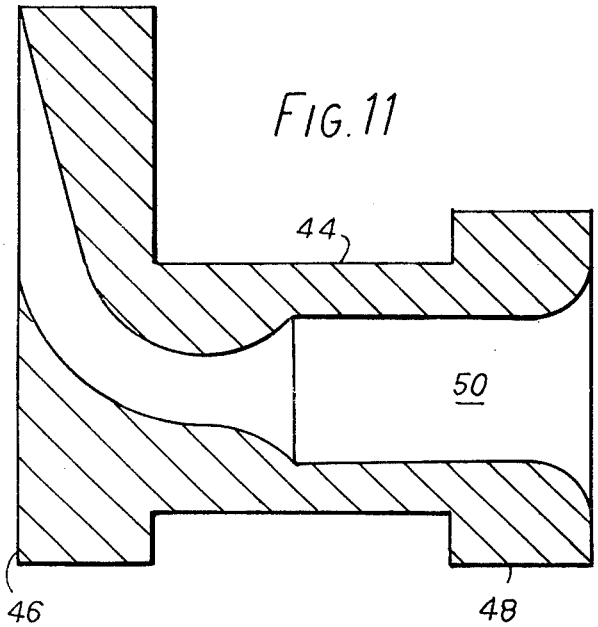
Figure 12:
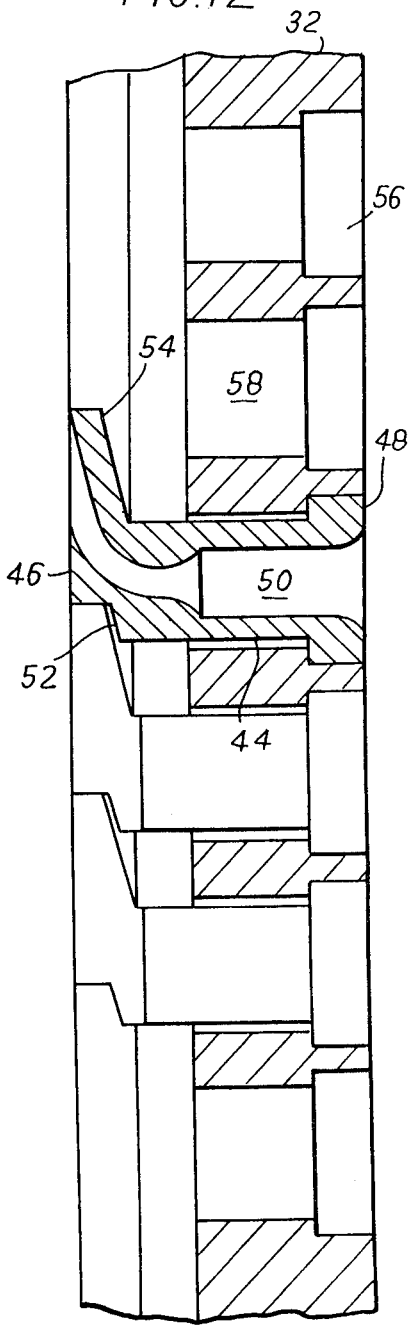
Figure 13:
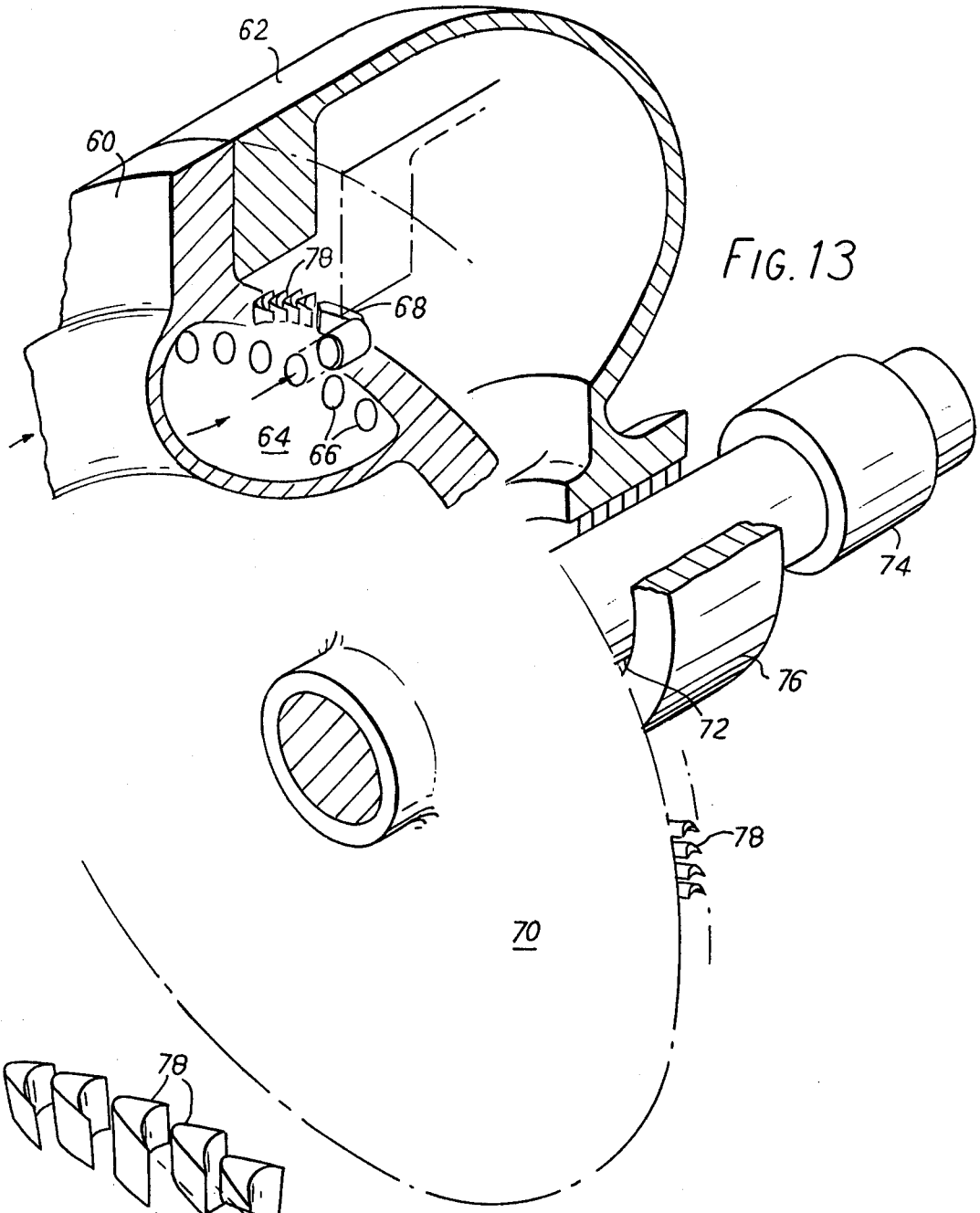
Figure 14:
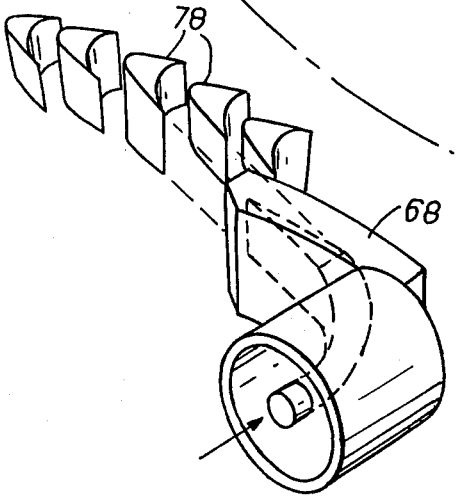
Figure 15:
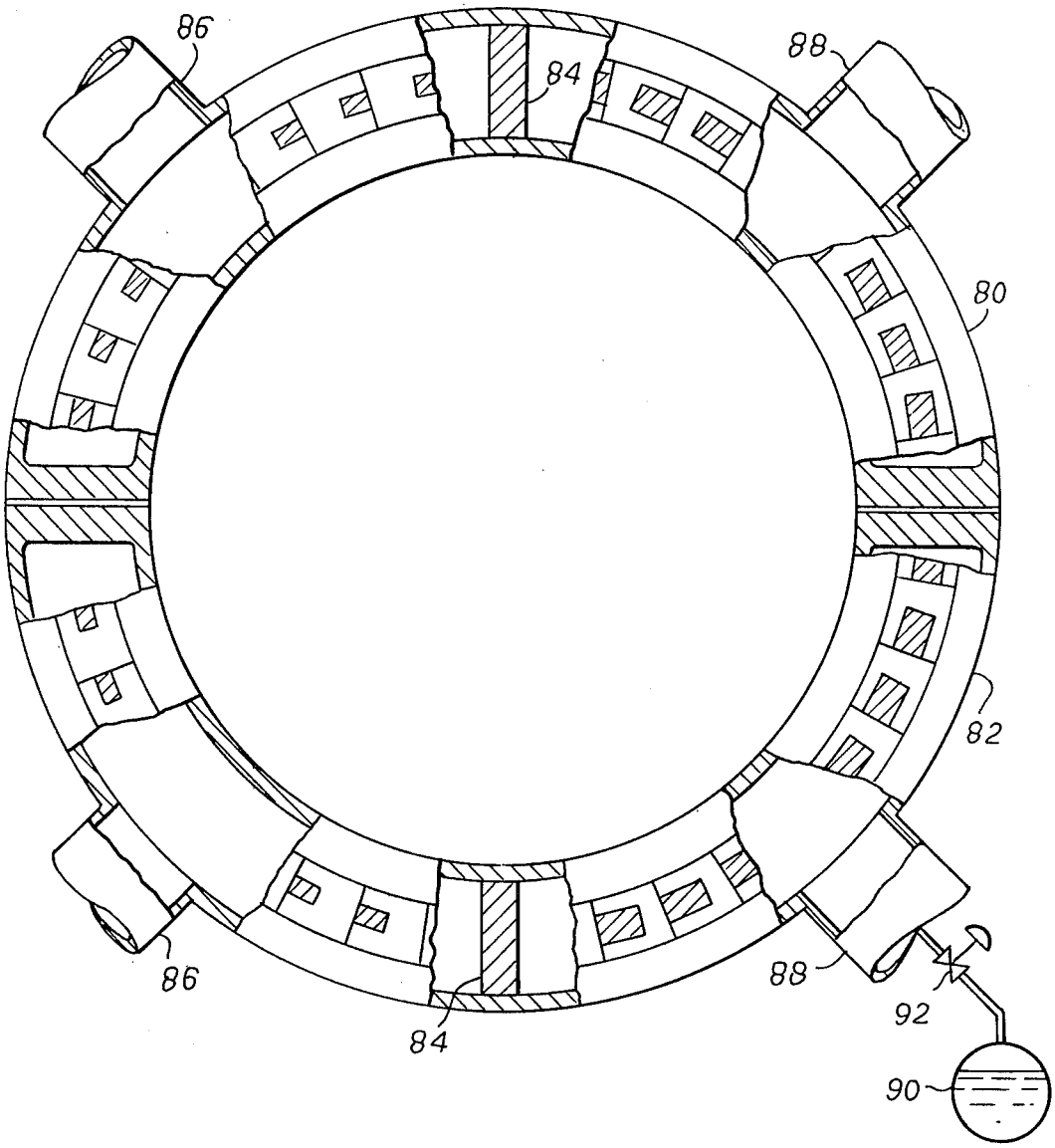

The invention will now be described further by way of example with reference to the accompanying drawings in which:

FIG. 1 is a sectional elevation through a nozzle insert for "front fitting" to a nozzle ring or turbine casing, FIGS. 2 to 7 are cross sectional views of the passageway extending through the insert and taken on the lines II—II to VII—VII respectively of FIG. 1, FIG. 8 is a sectional view of part of a nozzle ring with a plurality of nozzle inserts received in individual bores therein, FIG. 9 shows one manner of retaining the nozzle inserts in a nozzle ring by means of an annular clamp ring, FIG. 10 is a sectional view taken on the line 10—10 of FIG. 9, FIG. 11 is a sectional elevation through a nozzle insert similar to that shown in FIG. 1 for "reverse fitting" to a nozzle ring, FIG. 12 shows the method of fitting the insert of FIG. 11 into a nozzle ring, FIG. 13 is a general perspective view, partly in section, showing a part of a steam turbine embodying the present invention, FIG. 14 is an exploded view of the ringed part of FIG. 13 and showing the manner in which an individual nozzle may be adjusted to match the inter turbine blade gap, and FIG. 15 is a partially sectioned elevation of a nozzle ring assembly to which a plurality of nozzle inserts in accordance with the invention are fitted.

The nozzle insert shown in FIG. 1 is cast by investment casting from an austentic or nimonic steel in accordance with British Standard EN58B. A suitable steel is that sold under the tradename of NIMOGAST 80 by Messrs Henry Wiggin and Company Limited of Hereford, England. The insert includes a cylindrical body portion 10 which defines a generally curved passageway 14. The passageway 14 may be considered to have two portions, the first of which extends from a steam inlet position 20 to a throat 16 and the second of which extends from the throat 16 to a mouth and exit 18.

The nozzle insert is generally L-shaped in cross section, the two arms of the L being generally designated 24 and 28 receive the corresponding arm 24 of an adjacent nozzle which is not shown in full. The arm 24 is chamfered at 26, the chamfered portion being received within the cut-away part of an adjacent nozzle insert.

The first portion of the passageway (between the steam inlet 20 and the throat 16) provides an inlet portion by means of which steam or like can be introduced smoothly into the second and operative portion of the passageway. The inlet portion of the passageway is generally funnel-shaped, the walls being curved inwardly. It is to be understood however that the shape of the inlet portion is not critical and need not, for example, be convergent as illustrated.

The second and operative portion of the passageway is generally curved and includes an arcuate section and a straight or rectilinear section adjoining the arcuate section at the opposite end of the passageway to the inlet portion. The angle subtended between the straight section of the passageway and the surface of the insert from which the straight section emerges, determines the angular presentation which steam or other working fluid makes to the inter-turbine blade spacing. In the illustrated embodiment this angle is 15 ° but the angle may be altered to suit different steam conditions and/or the required efficiency level. The passageway is of circular cross section at the throat 16 but smoothly and progressively alters in cross section as may be seen from FIGS. 2 to 7 to become rectangular in cross section at the mouth 18. The dimensions and angular presentation of the rectangular mouth and exit portion are matched to the shape and entry angle of the interturbine blade spacing of the turbine rotor which is rotatably received in a turbine casing to which the inserts are to fitted.

An end wall of one arm of the L-shaped insert nozzle includes the opening to the inlet portion 20 and the outer side of the other arm which side, in use, forms a turbine blade confronting surface which includes the rectangular mouth opening 18. From FIG. 1 it may be seen that said end wall of said one arm serves as a sealing face 22 for engagement in a nozzle ring (to be described), the periphery of the end wall serving as a section diameter for location purposes.

Referring now to FIG. 8 there is shown a nozzle ring 32 which may be of any suitable material such as cast or forged steel. The ring includes a plurality of evenly, angularly spaced, counterbored bores 34 located on a pitch of predetermined diameter each bore receiving a nozzle insert. The nozzle inserts are disposed with their respective arms 28 received in the counterbored parts of the bores 34 so that the inlet portions of the nozzle passageways are connected with the narrower diameter portions 35 of the bores 34. It may thus be seen that the arms 24 are arranged in overlapping and abutting relationship with adjacent inserts, lines a abuttment thus being radii of the nozzle ring assembly.

In some instances, dependant upon the axial clearance between the nozzles and moving rotor blades (not shown in FIG. 8) the nozzle angle and mean operating diameter the location so described may not provide maximum efficiency for the steam jet path between the nozzle exit and moving the blade entry. In such cases the nozzle inserts will require rotation on their axes within the counterbored portion of location bores 34 to enable maximum efficiency to be obtained. In such instances the extreme edges of exit 18 may not be parallel to the nozzle insert abutment radii as is illustrated in FIG. 9.

FIG. 9 shows the use of a blanking piece 40 to complete a full 360° arc of nozzles the blanking piece being bolted to the nozzle ring 32 by means of a bolt 41. The inserts are retained in position by a clamping ring 42 so that individual inserts may readily be replaced in the event of damage during service. If necessary the inserts may be provided with 'O' ring seals such for example as pressure filled stainless steel seals typically those known as "wills" (Registered Trade Mark) for positive leakage control, dependant upon the steam conditions of a particular installation.

The reverse fitting nozzle insert shown in FIG. 11 includes a generally cylindrical body 44 having flanges 46, 48 at the opposite ends thereof. A steam passageway 50 extends through the insert, the passageway being of the same shape as that of the insert shown in FIG. 1.

The same basic shape of insert as FIG. 11 is shown in FIG. 12 except that the ends of the flange 46 are removed at 52, 54 to enable a plurality of inserts to be mounted in overlapping relationship in a nozzle ring 32. To complete a nozzle ring assembly the flanged end 46 of an insert is introduced into a counterbored part 56 of bore 58 and slid through the bore. As the flanged end passes through the bore, the whole insert may be rotated in a generally clockwise direction until the flange 48 rests in the counterbore 56. An adjacent insert may then be placed in the ring until the ring assembly is complete.

One advantage of a nozzle ring assembly embodying reverse fitting inserts is that the steam pressure which is to pass through the steam passageway 50 also serves to press the flange 48 into sealing engagement with the counterbore 56 in the nozzle ring so that the steam pressure holds and seals each insert in position.

As an alternative to the nozzle inserts being mounted in a nozzle ring assembly, they may be mounted in the rotor casing.

Thus, in FIGS. 13 and 14 the two parts of a turbine casing are designated 60 and 62. The part 60 includes a toroidal manifold 64 in a turbine blade-confronting surface of which a plurality of bores 66 are provided. Each bore removably receives a nozzle insert 68 only one of which is illustrated for the sake of clarity. Steam or other working fluid is introduced through the toroidal manifold 64 and hence passes through each of the nozzle passageways in the manner described previously and emerges from the nozzle exits.

A rotor 70 is fixedly supported upon rotor shaft 72 which is rotatably mounted in bearing 74 is known manner. A gland seal 76 serves to prevent leakage of working fluid from the casing part 62 in known manner. The rotor carries a plurality of angularly spaced turbine blades 78 only some of which are shown for clarity.

In operation whether the nozzle inserts are supported in a nozzle ring assembly in or between turbine casing parts, high pressure, high temperature steam typically at 500 psi and 750° F is introduced into the inserts from a source of steam pressure (Not shown) such as a boiler. The steam passes around a toroidal passage of the nozzle ring or a part of the high pressure turbine casing and out of nozzle inserts into the low pressure turbine casing. Steam is directed out of each nozzle with approximately the same velocity, each steam jet having the correct angular relationship with the moving blades, and of correct cross sectional shape to enter the inter-blade spacing of the moving turbine blades with maximum efficiency and thus turn the turbine rotor with minimum losses.

It will be understood that a rotor of a steam turbine can be made to rotate in either direction in dependence upon the manner in which the moving blades are presented to the nozzles and the manner upon which nozzles are inserted into the nozzle ring. Thus, with the nozzles mounted in one circumferential direction, the rotor with suitable blading is made to rotate in one mode, for example clockwise. The samebasic shape of nozzle inserts but with the abuttment angle reversed can be mounted in the opposite circumferential direction to cause the rotor, with suitable blading, to rotate anti-clockwise. In this way a common nozzle insert can be used to provide right and left hand drives with appropriately handed rotor blading.

An alternative nozzle ring assembly is shown in FIG. 15 and is in two semi-circular and separate halves 80 and 82. Each half is divided in two by a baffle 84 so that the nozzle arc is effectively in the form of four quarter segments. Each segment has a spigot connection thereto, the connections 86 enabling high pressure steam, typically at 500 psi, to be introduced into two segments and the connections 88 enabling lower pressure steam, typically at 150 psi to be introduced into the other two segments.

Steam is introduced to each nozzle segment from a boiler 90 through control valve 92 shown diagrammatically. Thus the nozzle inserts in successive pairs of segments are sized and arranged to utilise either high to low pressure steam supplies with maximum efficiency. Likewise separate nozzle arcs can be arranged with individual spigot connections and control valve for maximum efficiency at part loads.

Steam turbines differ dimensionally relative to one another depending upon power, steam flow, steam conditions and speed etc., the controlling dimension being the mean diameter of the nozzle ring. For optimum efficiency there is a known mathematical ratio between the heat and energy in the steam and the mean nozzle ring and rotating blade diameters. Normally nozzle segments are machined to fit pressure vessels having fixed mean diameters, there being no possible interchange of segments between casings of differing diameter, whereas the nozzle insert of the invention described herein can be applied to infinitely variable mean diameter.

A common external shape of nozzle insert may be used to define a plurality of passageways of different shape to enable the optimum performance for a particular turbine to be achieved from the parameters individual thereto. The passageway shapes can be formed by using ceramic cores in the known process of investment casting, thus obtaining a good surface finish and close tolerance dimensions required for maximum nozzle/-blade efficiency without need of further machining.

An alternative method of producing the passageway shape is by machining the nozzle insert from solid material in halves as sectioned in FIG. 1. Half of the passageway could then be machined by electrical discharge methods for instance, in each nozzle insert half, which placed together as a right and left hand portion would produce an enclosed passageway as before. The nozzle insert halves are then vacuum brazed or electron beam welded together to provide a totally enclosed steam-tight vessel.

Steam turbines of known types can be modified to accept the nozzle insert of the invention with an annular clamp ring arrangement as described. Alternatively, the nozzle inserts may be clamped between the joint faces of adjacent pressure vessels.

Whereas the embodiments of the invention described above are of steam turbines it is to be understood that the invention is applicable to turbines generally. Furthermore, whereas in the described embodiments of the invention the nozzle inserts are described as mounted in a nozzle ring, it is not essential that this be so since any convenient nozzle mounting may be utilised.

It will be apparent to those skilled in the art that various modifications and improvements may be resorted to without departing from the spirit and scope of the invention.

What is claimed is:

1. A nozzle insert for a turbine said insert having a turbine blade-confronting surface, a working fluid passageway extending through said insert, an inlet and an exit to said passageway, said exit being a rectangular opening in said turbine blade-confronting surface, said passageway having an arcuate section adjacent said inlet and a rectilinear section adjacent said centre line through the rectilinear section of the passageway making an acute angle with said turbineblade confronting surface.

2. A nozzle insert as set forth in claim 1 wherein the inlet of the passageway comprises a throat of circular cross section, the cross sectional shape of the passageway changing progressively and smoothly from circular to rectangular at said turbine blade confronting surface.

3. A nozzle insert as set forth in claim 1 wherein the cross section of the passsageway is rectangular throughout, the shape of the rectangle making a smooth transition between the inlet and exit of the passageway.

4. A nozzle insert as set forth in claim 1 which is formed in a single piece.

5. A nozzle insert as set forth in claim 1 which additionally comprises a passageway for introducing working fluid into said inlet said passageway being formed integrally with the insert.

6. A nozzle insert as set forth in claim 1 which additionally comprises a passageway for introducing working fluid into said inlet, said passageway being formed integrally with the insert and being generally frustoconically shaped, the walls of the passageway being inwardly domed to assist the flow of working fluid into said inlet.

7. A nozzle insert as set forth in claim 1 including means for enabling the insert to be adjustably mounted in a nozzle ring.

8. A turbine comprising a casing within which a rotor carrying a plurality of angularly spaced rotor blades is rotatably received, means removably mounting a plurality of nozzle inserts in said casing each insert being arranged, in use, to direct working fluid at said rotor blades to thereby rotate said rotor, each insert having a working fluid passageway extending therethrough and forming a rectangular exit in a turbine blade-confronting surface of the insert, said passageway having an arcuate section adjacent an inlet of the passageway and a rectilinear section adjacent the exit from the passageway, a centre line through the rectilinear section of the passageway making an acute angle with said turbine blade-confronting surface.

9. A turbine as set forth in claim 8 wherein the means removably mounting the inserts comprises a nozzle ring or ring-like assembly which is received in the turbine casing intermediate the ends thereof.

10. A turbine as set forth in claim 8 wherein the means removably mounting the inserts comprises a nozzle ring or ring-like assembly which is received in the turbine casing intermediate the ends thereof, a plurality of counterbored bores in said nozzle ring or ring-like assembly each of which removably and adjustably receives a nozzle insert, and clamping means for clamping said inserts in said ring or ring-like assembly.

11. In a turbine comprising a casing, a turbine rotor rotatably received in said casing, a plurality of angularly spaced rotor blades mounted on said rotor, a plurality of nozzle inserts each nozzle insert being operative to direct working fluid at said rotor blades to thereby rotate said rotor each insert having a turbine blade confronting surface a working fluid passageway extending through each said insert, an inlet and an exit to said passageway, said exit being a rectangular opening in said turbine blade confronting surface, said passageway having a first, arcuate section adjacent said inlet and a second, rectilinear section adjacent said exit, a centre line through the rectilinear section of the passageway making an acute angle with said turbine blade confronting surface, means removably mounting the inserts in said casing, said means comprising a nozzle ring or ring-like assembly which is received intermediate the ends of the turbine casing a plurality of counterbored bores in said nozzle ring or ring-like assembly each of which removably and adjustably receives a nozzle insert, clamping means for clamping said inserts in said ring or ring-like assembly with said inserts arranged in overlapping relationship.

12. A turbine as set forth in claim 11 wherein each insert has an arm which is received in a recess of an adjacent insert taken in one circumferential direction of the nozzle ring or ring-like assembly and a recess in which is received the arm of an adjacent insert taken in the other circumferential direction.

13. A turbine as set forth in claim 11 wherein the clamping means comprises an annular ring which is clamped removably to a turbine confronting face of the nozzle ring or ring-like assembly.

14. A turbine as set forth in claim 11 wherein the nozzle ring or ring-like assembly is counterbored in a face remote from the turbine blade confronting face thereof, the body of the insert being passed through the bore during assembly and a flanged end of the insert being received in said counterbore.

* * * * *